US009259632B2

(12) United States Patent
DiLorenzo et al.

(10) Patent No.: US 9,259,632 B2
(45) Date of Patent: Feb. 16, 2016

(54) ANKLE FLOAT BUOY

(71) Applicant: TYR Sport, INc., Farmingdale, NY (US)

(72) Inventors: Matthew V. DiLorenzo, Plainview, NY (US); Philip M. Bayer, Brooklyn, NY (US); Kyle D. Sola, Brooklyn, NY (US); Yang Wang, Syosset, NY (US)

(73) Assignee: TYR SPORT, INC., Farmingdale, NY (US)

( * ) Notice: Subject to any disclaimer, the term of this patent is extended or adjusted under 35 U.S.C. 154(b) by 0 days.

(21) Appl. No.: 14/247,407

(22) Filed: Apr. 8, 2014

(65) Prior Publication Data

US 2015/0283447 A1 Oct. 8, 2015

(51) Int. Cl.
*A63B 31/00* (2006.01)
*A63B 69/12* (2006.01)

(52) U.S. Cl.
CPC ..... *A63B 69/12* (2013.01); *A63B 31/00* (2013.01)

(58) Field of Classification Search
CPC .... A63B 69/12; A63B 69/14; A63B 2244/20; A63B 31/08; A63B 31/10; A63B 31/11; A63B 31/00; A63B 31/12; A63B 31/14; A63B 35/00; A63B 2208/03; A63B 21/4011; A63B 21/4013; A63B 21/4015
See application file for complete search history.

(56) References Cited

U.S. PATENT DOCUMENTS

| | | | | |
|---|---|---|---|---|
| 2,295,906 A | | 9/1942 | Lacour | |
| 2,536,390 A | | 1/1951 | Pobochenko | |
| 3,528,116 A | | 9/1970 | Fenar | |
| 3,604,023 A | * | 9/1971 | Lynch | 5/650 |
| 3,771,181 A | | 11/1973 | Dansereau | |
| 4,090,268 A | | 5/1978 | Turner | |
| 4,747,779 A | | 5/1988 | Gerstung | |
| 5,344,373 A | | 9/1994 | Greene | |
| 5,389,058 A | | 2/1995 | Tinari | |
| 5,700,173 A | * | 12/1997 | Lerro | 441/57 |
| 5,746,218 A | | 5/1998 | Edge | |
| 6,154,905 A | | 12/2000 | Frydman | |
| 6,182,314 B1 | | 2/2001 | Frydman | |
| 7,169,000 B1 | * | 1/2007 | Hernandez | A63B 69/12 441/60 |
| 2009/0075537 A1 | * | 3/2009 | Devers | 441/129 |
| 2015/0258386 A1 | * | 9/2015 | Kim | A63B 31/12 441/60 |
| 2015/0259055 A1 | * | 9/2015 | Nakamoto | B63C 9/155 441/60 |

OTHER PUBLICATIONS

MDI Products Blog; http://www.mdiproducts.com/foamenting-ideas-blog/bid/32314/Why-Choose-EVA-for-Molded-Foam-Because-it-Makes-Soft-Parts Retrieved: Jun. 22, 2015 Posted: May 4, 2010.*

* cited by examiner

*Primary Examiner* — Oren Ginsberg
*Assistant Examiner* — Megan Anderson
(74) *Attorney, Agent, or Firm* — Stetina Brunda Garred & Brucker

(57) ABSTRACT

A unitary ankle float buoy for immobilizing the legs during swim training. The buoy is formed of a central portion connecting a top wall and a lower wall and a pair of ankle openings disposed on each side of the central portion. The ankle float buoy is designed and configured to be worn upon both ankles of a swimmer below the calf and above the foot.

9 Claims, 4 Drawing Sheets

ANKLE FLOAT BUOY

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present disclosure relates generally to an ankle floatation device, and more particularly to a swim training device that maintains a swimmer's legs in a fixed position to focus on the swimmer's core and shoulder training while swimming.

Typically, swimming utilizes an arm stroke and kicking of the legs to propel the swimmer through water. While the arm stroke generally provides the majority of thrust, strong kicking can often compensate for a weak arm stroke. In order to overcome this compensating ability, it is often desired to remove the legs from the stroke to focus on the core and arm muscles to improve the arm stroke. However, one cannot simply stop kicking, as the legs would sink in the water causing an increased amount of drag that would need to be overcome. Additionally, paraplegic swimmers, or others with inabilities to kick their legs sufficiently, would be aided by a device to maintain and float the legs, while allowing them to swim only using the arm stroke.

In order to overcome these problems, various solutions have been introduced. Traditionally, foam pull buoys have been used. These pull buoys are figure-8 shaped devices that are held between the legs of the swimmer, by the swimmer exerting a closing force with their legs onto the pull buoy. This closing exertion, however, can be uncomfortable and tiring for the user and still allows for a certain degree of kicking being performed by the swimmer. Initial attempts to overcome these deficiencies include further tying straps to the swimmer's leg to maintain the pull buoy in position without requiring a closing exertion from the swimmer and to further limit the kicking ability. However, these straps can be cumbersome and difficult to attach and remove. An advance on this technology was described in U.S. Pat. No. 7,169,000, which discloses a swimming aid training device that includes a buoy assembly that attaches to a swimmer's calf area and a fin assembly to prevent the swimmer from twisting their torso. However, in most swimming strokes, the swimmer's torso rolls from side to side during the arm stroke. This side-to-side roll requires the swimmer to exhibit a great deal of core strength and endurance. If the swimmer lacks the necessary core strength, the swimmer may break form. As such, if one is desiring to increase the strength and proficiency of their core, this device is not ideal. Further, its placement on the calf area does not place the buoyant force at a distal region of the swimmer's legs and, due to the tapering shape of the calf region, requires a difficult to form configuration that tapers from the opening to the exit and is described as a "substantially rotated H-shape".

As such, there is a need for an improved swim training device that not only allows a swimmer to focus on their arm stroke, but also allows the swimmer to properly work their core, while maintaining their legs in a fixed position with a buoyant force being provided at the ankle region, in an easy to enter and exit configuration, that is further easily and economically manufactured.

BRIEF SUMMARY

In accordance with one embodiment of the present disclosure, there is contemplated a unitary ankle float buoy for immobilizing the legs during swim training. The buoy is formed of a central portion connecting a top wall and a lower wall. The top wall extends outward from the central portion in both directions and curves downward at distal ends, while the lower wall extends outward from the central portion in both directions and curves upward at distal ends. Further, the buoy has a pair of ankle openings disposed on each side of the central portion, below the top wall and above the lower wall. Each ankle opening is defined by a sidewall of the central portion, a rear opening, a front opening, and a side opening. The central portion, top wall, and lower wall define a front edge on the side of the buoy having front openings and a rear edge on the side of the buoy having rear openings. The ankle float buoy is designed and configured to be worn upon both ankles of a swimmer below the calf and above the foot. To aid in fitting the buoy on the swimmer's ankles, the rear edge may narrow from the central portion to the distal ends to comfortably accommodate the swimmer's lateral malleolus.

In certain embodiments, the ankle openings may be formed in a substantially straight cylindrical configuration, wherein the front and rear openings, and the portions between the two openings, are substantially the same size. In particular, this substantially straight configuration may be achieved when the buoy is formed from a solid piece of buoyant, resilient foam and the ankle openings are cut from the piece of foam.

In other embodiments, the ankle openings may be formed in a convex configuration, such that the front and rear openings are wider than a segment of the ankle openings located between the front and rear openings. In particular, this convex configuration may be achieved readily when the buoy is formed from a compression molded foam. One benefit of the convex shape may be that the narrower portion between the rear and front openings may assist in securing the buoy to the swimmer as the portion of the ankle between the swimmer's foot and calf region is generally narrower, thereby allowing the convex formation to better fit to the swimmer's anatomy.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
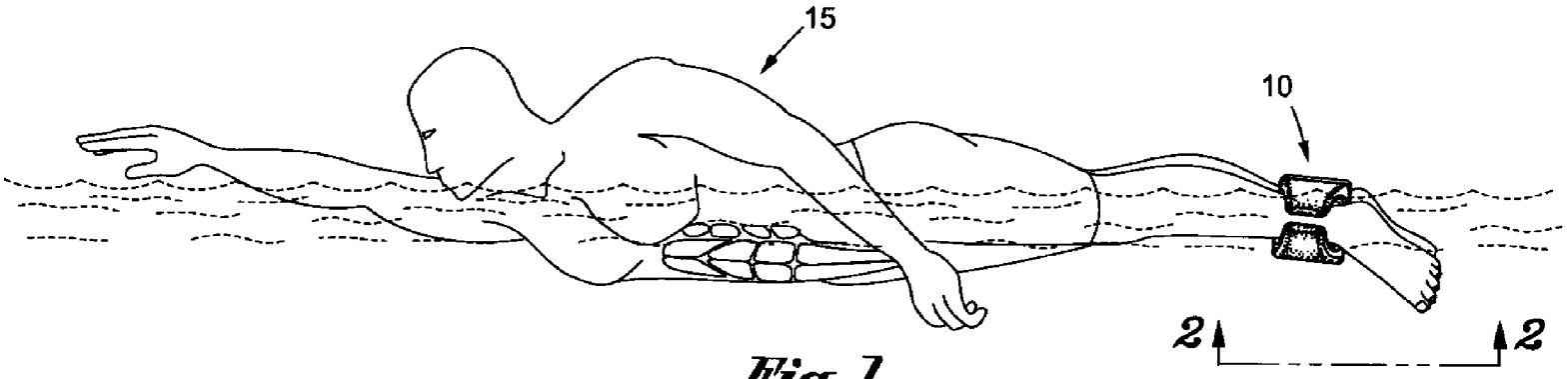
FIG. 1 is a side view of an ankle float buoy in use on a swimmer.

As shown in FIG. 1, an ankle float buoy 10 is attached to the ankle region of a swimmer 15. This configuration allows the swimmer 15 to isolate and train their arms, shoulders, and core region by focusing on the arm stroke. The buoy 10 may formed of a buoyant, resilient material and is configured to be easily attachable to the ankle region 25 of the swimmer 15. By locating the buoy 10 on the ankles 25, the buoyant force provided by the buoy 10 is at a distalmost portion to maintain the swimmer's body in proper form, while also maintaining a secure attachment to the swimmer 15. As can be seen, the ankle region 25 defines a narrow point of the swimmer's leg. As such, while the buoy 10 is easily attachable and removable from the swimmer's body, it remains securely attached during swimming without the need for cumbersome straps or other securing means. Further, the design and configuration of the buoy 10 can be simplified to maintain its position at the ankle, in comparison to other configurations where the device would be attached to a user's calf area. Generally, the calf is wider at the upper portion and narrows to the lower portion as you approach the ankle. As such, in devices attached to a swimmer's calf, the geometry of the openings have to be tapered in such a fashion to match the user's calf, resulting in more complicated and/or expensive fabrication demands along with the possibility of shifting or unintended detachment from the swimmer during use.

Figure 2:
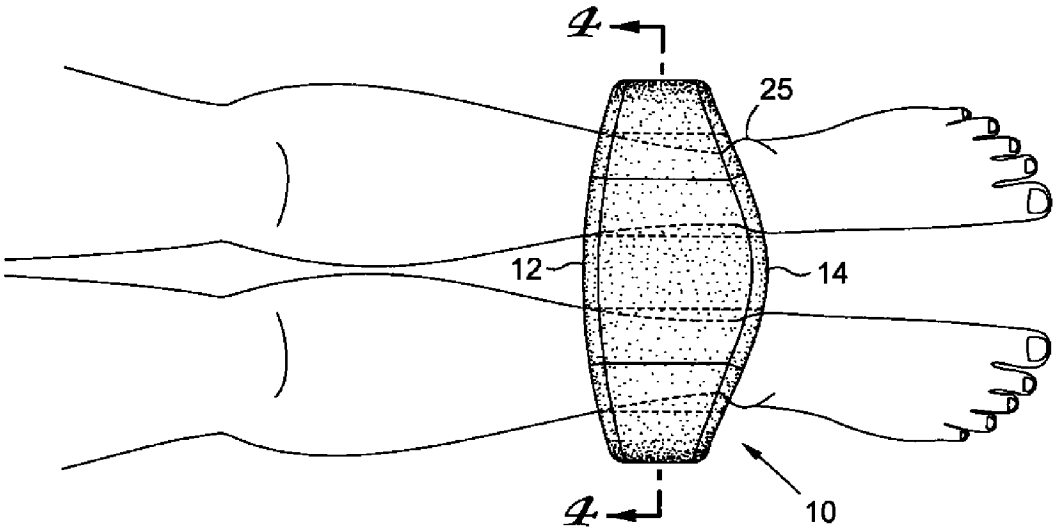
FIG. 2 is a bottom view of the ankle float buoy of FIG. 1.
Figure 4:
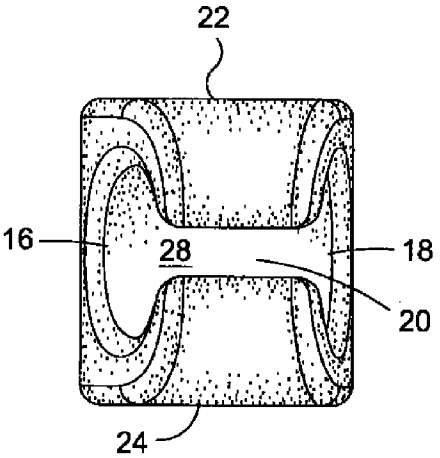
FIG. 4 is a side view of the ankle float buoy of FIG. 1.
Figure 3:
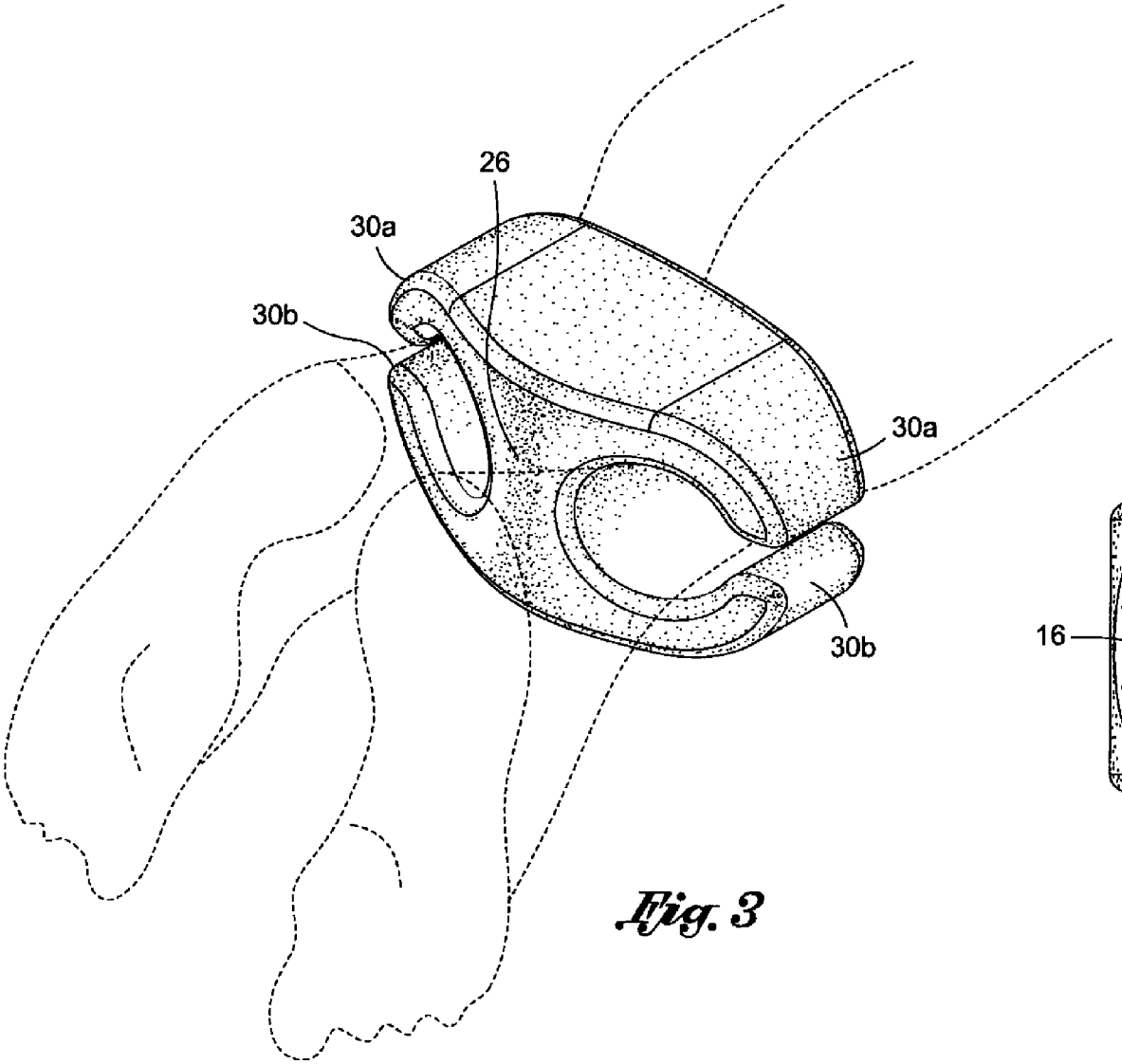
FIG. 3 is a perspective view of an ankle float buoy in use on a swimmer.
Figure 5:
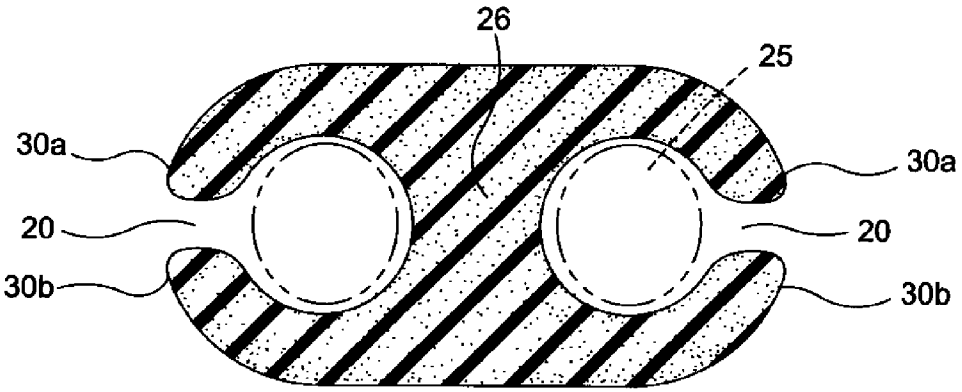
FIG. 5 is a cross-sectional view of the ankle float buoy of FIG. 2 with the swimmer's legs in place.

As can be seen in FIG. 2, the buoy 10 is attached to the ankles 25 of the swimmer 15 such that the buoy 10 has a front edge 12 facing in the direction of the swimmer's movement through the water and a trailing rear edge 14. As best seen in FIGS. 3 and 4, the buoy 10 includes a pair of ankle openings for receiving the ankles 25 of the swimmer 15. The ankle openings are defined by various openings and walls to receive and maintain the ankles. In particular, the ankle openings include a rear opening 16 that, in use, is located at the bottom of the ankle 25 near the swimmer's foot and a front opening 18 disposed on the opposite side of the buoy 10 that, in use, is located at the top of the ankle 25 near the swimmer's calf. Further, the ankle openings have a side opening 20 that allows for the easy entry and exit of the swimmer's ankles 25 from the buoy 10. As such, it can be seen that the ankle openings are open on three of its six sides. The three non-open sides are defined by a top wall 22, a lower wall 24, and an inside sidewall 28. As can be seen, the top 22, lower 24, and sidewalls 28 form a substantially C-shape configuration for maintaining the ankles 25 in place during use. The top wall 22 is connected to the lower wall 24 by a central portion 26, wherein the central portion has the sidewalls 28 on each respective side. As shown in FIGS. 3 and 5, the top wall 22 and lower wall 24 both extend bilaterally outward in a horizontal direction from the central portion 26. The distal ends 30*a* of the top wall 22 curve in a downward fashion to help secure the ankle 25 in place, while the distal ends 30*b* of the lower wall 24 curve in an upward fashion. As such the distal ends 30*a*, 30*b*, while not connected, approach each other to form a substantially C-shape configuration.

The front edge 12 is defined by the top wall 22, lower wall 24, and central portion 26 on the side of the buoy 10 having front openings 18 and the rear edge 14 is defined by the top wall 22, lower wall 24, and central portion 26 on the side of the buoy 10 having the rear openings 16. In certain embodiments, the rear edge 14 may be contoured to better accommodate the swimmer's lateral malleolus (the outer protrusion of the ankle). In particular, the rear edge 14 may take a convex configuration such that the central portion 26 extends further than the distal ends 30*a*, 30*b* along the rear edge 14. By tapering inward at the distal ends 30*a*, 30*b*, the buoy 10 may avoid encompassing the swimmer's lateral malleolus during use, thereby providing a more comfortable design than if the buoy 10 were provided in a substantially straight configuration that encompassed the user's lateral malleolus during use.

Figure 6:
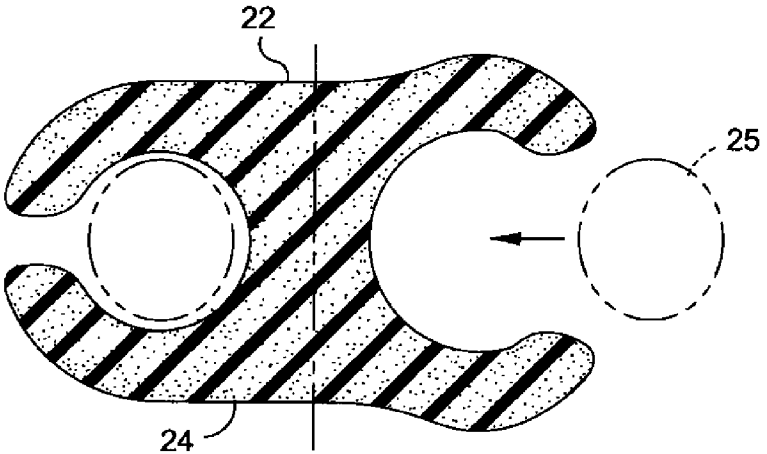
FIG. 6 is a cross-sectional view of the ankle float buoy of FIG. 2 with the swimmer's legs partially in place.
Figure 8:
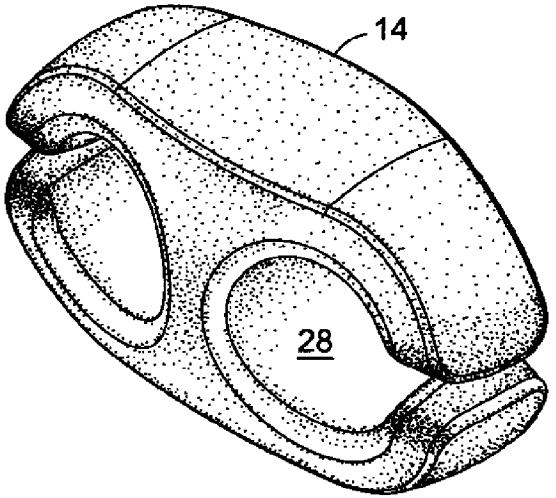
FIG. 8 is a perspective view of the ankle float buoy of FIG. 7.
Figure 10:
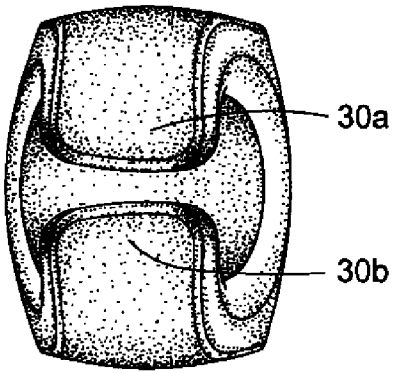
FIG. 10 is a side view of the ankle float buoy of FIG. 7.
Figure 7:
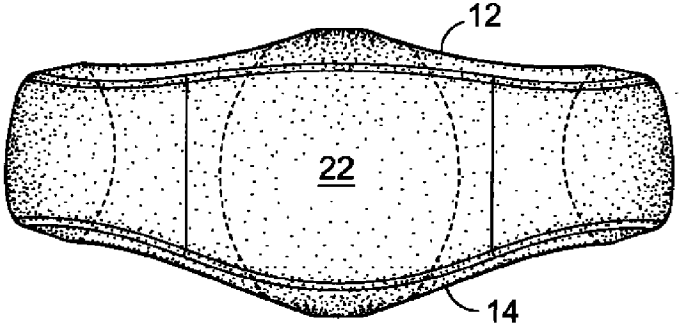
FIG. 7 is a top view of another embodiment of an ankle float buoy.
Figure 9:
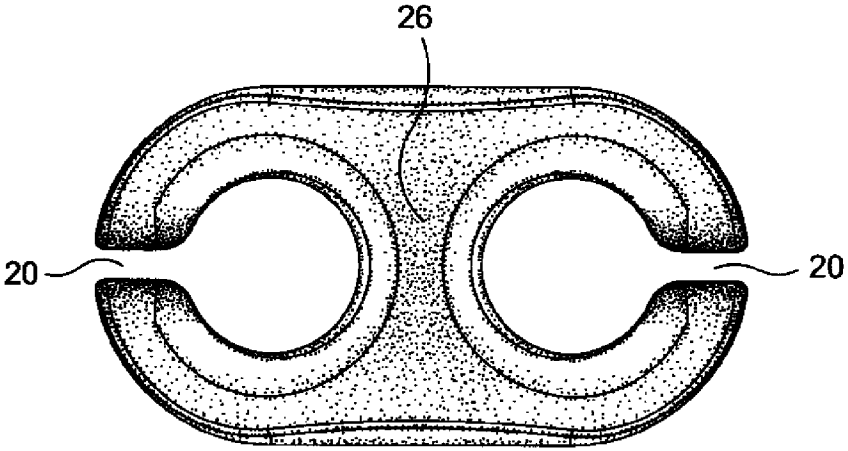
FIG. 9 is a front view of the ankle float buoy of FIG. 7.

The buoy 10 is preferably formed from a buoyant and resilient material in order to provide floatation assistance to the swimmer while maintaining its shape during use, but being readily deformable to allow for easy entry and exit of the swimmer's ankle 25. For example, the buoy may be formed from a foam polymer such as polyethylene or ethylene-vinyl acetate (EVA) FIG. 6 shows the entry of the ankle 25 into the ankle openings of the buoy 10. As can be seen in this figure, the distal ends 30*a*, 30*b* may be deformed away from their typical closed position into an open configuration to allow for the entry of the ankle 25. Whereupon when the ankle 25 is in position in the ankle opening of the buoy 10, the resilient material returns to its normal closed position thereby securing the buoy 10 in proper position during use (as seen in FIG. 5).

As shown in phantom in FIG. 2, the ankle openings may be formed in a substantially straight cylindrical shape. This embodiment may be formed, for example, by cutting the ankle openings out of a block of foam. This configuration, while easy to form does not perfectly follow the anatomy of the ankle and allows for some play between the buoy 10 and the ankles 25, while still maintaining the buoy 10 in position during use.

In an alternative embodiment, shown in FIGS. 7-10, the ankle openings may be formed in a convex configuration. That is, the portion of the ankle opening at the rear 16 and front opening 18 is wider than the portion between the two openings. This configuration allows for the buoy 10 to better grip the swimmer's ankles 25. This configuration may formed by compression molding a piece of foam to form the convex shape of the ankle openings.

As such, it can be seen from the unique configuration disclosed herein, the buoy may be easily placed upon the user and removed from the user without a need for complicated and cumbersome straps or other attaching devices. Further, the configuration allows for easy and economy in the manufacturing process in that complex geometries and shapes are not necessary to maintain the position of the buoy on the user's ankles. Additionally, the placement of the buoy on the swimmer's ankle region, as opposed to the calf or thigh region, places the source of buoyancy at a distalmost portion of the leg region, thereby providing buoyancy in a location that is able to maintain the swimmer in proper alignment within the water. In addition to the use of a buoyant material in forming the buoy, it is envisioned that the buoy may further be configured in such a fashion to act as a hydrofoil. That is, the outer shape of the buoy may be optimized such that the lift generated by propulsion through the water while in use is substantially larger than the drag generated by the buoy. By shaping the buoy in such a manner, it further acts in a manner to maintain the swimmer's body in proper alignment during use.

The above description is given by way of example, and not limitation. Given the above disclosure, one skilled in the art could devise variations that are within the scope and spirit of the invention disclosed herein, including various ways of forming the ankle float buoy and various sizes of the ankle float buoy for swimmers of different ages and sizes. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A unitary ankle float buoy for immobilizing swimmer's legs during swim training, said unitary ankle float buoy comprising:

a central portion connecting a top wall and a lower wall, wherein the top wall extends outward from the central portion and curves downward at distal ends, and wherein the lower wall extends outward from the central portion and curves upward at distal ends;

a pair of ankle openings disposed on each side of the central portion, below the top wall and above the lower wall, wherein each of the ankle openings are defined by a side wall of the central portion, a rear opening, a front opening, and a side opening;

wherein the central portion, top wall, and lower wall define a front edge on the side of the unitary ankle float buoy defining the front openings and a rear edge on the side of the unitary ankle float buoy defining the rear openings;

wherein the unitary ankle float buoy is worn upon both ankles of a swimmer below a calf and above a foot;

wherein each of the ankle openings at the front and rear edges are wider than portions between the front and rear edges.

2. The unitary ankle float buoy of claim 1, wherein the ankle openings are formed in a convex configuration, such that the front and rear openings are wider than a segment of the ankle openings located between the front and rear openings.

3. The unitary ankle float buoy of claim 2, wherein the unitary ankle float buoy is formed from a compression molded foam.

4. The unitary ankle float buoy of claim 1, wherein the rear has a convex configuration so that the central portion extends further than the distal ends to comfortably accommodate a swimmer's lateral malleolus.

5. The unitary ankle float buoy of claim 1, wherein the unitary ankle float buoy is formed from a solid piece of buoyant, resilient foam and the ankle openings are cut from the piece of foam.

6. The unitary ankle float buoy of claim 1 wherein a longitudinal cross sectional configuration of the ankle openings is convex.

7. A buoy positioned at ankles of legs of a swimmer for immobilizing the swimmer's legs from kicking during swim training, the buoy comprising:

a central portion connecting a top wall and a lower wall, wherein the top wall extends outward from the central portion and curves downward at distal end portions, and wherein the lower wall extends outward from the central portion and curves upward at distal end portions;

a pair of ankle openings disposed on each side of the central portion, below the top wall and above the lower wall, wherein each of the ankle openings are defined by a side wall of the central portion, a rear opening, a front opening, and a side opening to allow the swimmer's ankles to be inserted or removed from the ankle openings;

wherein the central portion, top wall, and lower wall define a front edge on the side of the buoy defining the front openings and a rear edge on the side of the buoy defining the rear openings;

wherein the buoy is simultaneously worn upon both ankles of a swimmer below calves and above feet of the swimmer so that the legs are immobilized from kicking during swim training;

wherein interior surfaces of the ankle openings are sized to the ankles of the swimmer's legs so as to contact the swimmer's ankles during swim training and configured to an area above the ankles, the ankles and the feet to retain the buoy on the ankles during swim training.

8. A method of wearing a unitary ankle float buoy, the method comprising the steps of:

providing the unitary ankle float buoy comprising:

a central portion connecting a top wall and a lower wall, wherein the top wall extends outward from the central portion and curves downward at distal ends, and wherein the lower wall extends outward from the central portion and curves upward at distal ends;

a pair of first and second ankle openings disposed on each side of the central portion, below the top wall and above the lower wall, wherein each of the first and second ankle openings are defined by a side wall of the central portion, a rear opening, a front opening, and a side opening;

wherein the central portion, top wall, and lower wall define a front edge on the side of the unitary ankle float buoy defining the front openings and a rear edge on the side of the unitary ankle float buoy defining the rear openings;

wherein the unitary ankle float buoy is worn upon both left and right ankles of a swimmer below a calf and above a foot;

wherein the rear edge and the front edge of each of the ankle openings are wider than a portion between the front and rear edges;

inserting the left ankle into the first ankle opening;

inserting the right ankle into the second ankle opening.

9. The method claim of claim 8 further comprising the step of allowing the rear edge to contact the foot to prevent the unitary ankle float buoy from dislodging from the ankles of the swimmer.

* * * * *